US005793288A

United States Patent [19]

Peterson et al.

[11] Patent Number: 5,793,288

[45] Date of Patent: Aug. 11, 1998

[54] INTRUSION ALARM WITH INDEPENDENT TROUBLE EVALUATION

[76] Inventors: John Peterson, 359 Glencairn Avenue, Toronto, Ontario, Canada, M5N 1V2; Reinhart Karl Pildner, 44 Madoc Drive, Brampton, Ontario, Canada, L6V 1Z9; Dennis Cecic, 86 Celeste Drive, Scarborough, Ontario, Canada, M1E 2V1

[21] Appl. No.: 534,104

[22] Filed: Sep. 26, 1995

Related U.S. Application Data

[63] Continuation of Ser. No. 227,584, Apr. 14, 1994, Pat. No. 5,453,733, which is a continuation of Ser. No. 978,420, Nov. 18, 1992, abandoned, which is a continuation-in-part of Ser. No. 915,178, Jul. 20, 1992, Pat. No. 5,444,432.

[51] Int. Cl.[6] ..... G08B 13/18

[52] U.S. Cl. ..... 340/567; 340/511; 340/522

[58] Field of Search ..... 340/567, 577, 340/578, 587, 506, 511, 512, 522, 529

[56] References Cited

U.S. PATENT DOCUMENTS

| | | | |
|---|---|---|---|
| 4,368,460 | 1/1983 | Clinard et al. | 340/522 |
| 4,468,658 | 8/1984 | Rossin | 340/567 |
| 4,660,024 | 4/1987 | McMaster | 340/522 |
| 4,831,361 | 5/1989 | Kimura | 340/506 |
| 5,077,548 | 12/1991 | Dipoala | 340/522 |
| 5,444,432 | 8/1995 | Pildner et al. | 340/567 |
| 5,453,733 | 9/1995 | Peterson et al. | 340/567 |

*Primary Examiner*—Thomas J. Mullen, Jr.

[57] ABSTRACT

An arrangement and method for processing signals from infrared microwave and/or ultrasonic intrusion detectors is disclosed which allows the signal to be processed at different amplitude levels to recognize different signal characteristics. This capability to analyse the signal at different values allows further customizing of the system for particular applications and provides information useful in recognizing and dealing with unwanted signal changes typical of the environment which can affect the reliability of the alarm criteria and/or trouble condition criteria. An assessment of the environment in a preferred aspect allows customizing of the alarm criteria to take into account the operating environment of the particular sensor or sensors. The system also accommodates increasing the effect on certain portions of the signal when considering the net overall effect of the signal. This results in more signal information being available to assess possible conditions which could lead or contribute to the generation of false alarms.

6 Claims, 6 Drawing Sheets

INTRUSION ALARM WITH INDEPENDENT TROUBLE EVALUATION

CROSS-REFERENCE TO RELATED APPLICATIONS

This application is a continuation of Ser. No. 08/227,584 filed Apr. 14, 1994, now U.S. Pat. No. 5,453,733, which is a continuation of Ser. No. 07/978,420 filed Nov. 18, 1992, now abandoned, which is a continuation in part of Ser. No. 07/915,178 filed Jul. 20, 1992, now U.S. Pat. No. 5,444,432.

BACKGROUND OF THE INVENTION

The present invention relates to intrusion detectors and in particular relates to a new arrangement and method for processing the signals received from sensors used in intrusion detection systems.

Passive infrared intrusion detectors, microwave detectors and ultrasonic detectors are often used in paired combinations to provide a system having a dual technology which is less prone to false alarms and is generally considered more reliable. The combination of passive infrared and microwave detectors is quite common, as the type of situations which can cause false alarms are generally not common to each detector, thus reducing the likelihood of false alarms. The combining of different detectors improves reliability and increases sophistication.

A number of existing dual technology intrusion detection systems make an evaluation of whether the overall system is working satisfactorily or whether the system, although not producing false alarms, may be in trouble. One such assessment of trouble is derived from counting the number of times one of the sensors produces an alarm output which is unconfirmed by the other detector. Typically there is some sort of decay function to decrease the number of false alarms counted at a certain rate, however, should the number of false alarms reach a predetermined maximum, a trouble indication is generated. Other dual technology systems look at the difference in numbers between the false alarms of each sensor for a further evaluation of whether the overall system is working satisfactorily. The generation of false or unconfirmed alarms as an assessment of whether the overall system is working satisfactorily has the disadvantage in that a large portion of the information contained within the signal from the sensor is not evaluated except to confirm when the signal has exceeded the alarm threshold condition. This assessment of trouble is also governed by the alarm criteria, which may not be the best assessment of whether the system is operating satisfactorily or operating within a satisfactory environment.

The signals from the different type of sensors are well known and are analysed with respect to particular criteria to derive a signal which is appropriately processed to determine whether an alarm condition exists.

The prior art systems have focused on alarm criteria and have included various compromises made to allow the two technologies to effectively monitor the same area. These compromises must take into account different operating environments and to reduce the possibility of false alarms. A detection system which produces false alarms is most troublesome and the industry is striving to produce systems which do not produce false alarms. Therefore, the industry is faced with the dilemma of trying to reduce false alarms while also providing a system which produces an alarm when an intruder enters the monitored space.

The signal from a passive infrared detector with respect to the disturbances which occur in the area being monitored can be characterized as an alternating signal sometimes considered predominantly sinusoidal whose magnitude typically varies between 0 and 3.6 volts peak to peak (5 volts supply) and whose frequency varies from 0.1 to 10 hertz.

Some approaches for analysing this signal from the passive infrared detector include the use of two comparators one for evaluating positive portion of the signal and the other for evaluating the negative portion. Pulses are produced when the signal exceeds the threshold of the respective comparator and are of a duration corresponding to the time that the signal remains above the minimum threshold. Thus positive pulses of variable duration have been derived by use of two comparators for evaluating positive and negative portions of the signal from the infrared detector. It is also possible to rectify the signal and merely use a single comparator for evaluation of the signal. The problems with the comparator approach is that it is difficult to determine what the best minimum threshold is. A number of factors can affect the signal from the detector and not all of these disturbances indicate that a burglar or intruder is present. RF transient signals produced when switching walkie-talkies between a receive and transmit mode, or the like RF transient signals, can produce a very strong, short duration signal. Heaters coming on within the monitored area can produce a detectable signal, as well as small animals such as a cat, etc., crossing through the zone. Therefore, a problem arises in trying to distinguish between the presence of a human intruder and a disturbance in the signal which is not produced by such an intruder. Use of this alarm criteria includes many compromises and much of the signal from the detector is ignored (i.e. all of the signal below and above the threshold).

A different approach has been to integrate the output signal to provide a measurement of the energy of the signal and it is believed this measurement is more indicative of whether an intruder is present. Unfortunately other factors enter into the consideration such as the ability of the system to detect the desired intruder at a long distance from the detector which typically produces a fairly low frequency signal. Other problems also occur due to the widely varying ambient temperature conditions that can occur in the monitored area. Analysis of the whole signal fails to recognize the different signals which can be partially evaluated by amplitude evaluation alone or in combination with duration and/or shape evaluation.

Many systems have used a single comparator to produce a pulse which is counted, and if sufficient pulses are produced within a certain time period an alarm condition is produced. Counting arrangements can produce false alarms as common environmental disturbances such as blasts of hot air from the heating vents will produce the same unit of information as the sensing of a valid target. In order to reduce the occurrence of false alarms it is possible to increase the comparator trip threshold and/or increase the number of pulses counted before an alarm is generated. Both of these techniques will indeed improve the false alarm immunity however this will be accomplished at the expense of the detection range of the unit. If the number of pulses counted before an alarm condition is produced is increased far detection range will be decreased since far targets will produce few pulses (due to low amplitude and frequency). If the thresholds are increased, far response will again be reduced since the far signals are of lower amplitude. It is for these reasons that maximum pulse setting allowed is typically 3.

In one prior art arrangement the output signal from the detector is fed into an absolute value circuit and subsequently to a voltage controlled pulse generator subsection. When the signal reaches a minimum amplitude the voltage controlled pulse generator begins to produce constant width pulses at a repetition rate proportional to the amplitude of the signal typically in the hundreds of hertz. These pulses are counted or integrated and stored by the means of a capacitor. When the stored energy reaches a preset level an alarm signal is generated. This system suffers the same basic draw backs as a window comparator system in that slowly changing low amplitude transients which barely cross over the threshold generate full amplitude pulses which are integrated towards a possible alarm generation.

Since the slow transients are allowed to produce the same unit of information as valid distance targets, the low frequency response of the amplifier has been set to de-emphasize low frequency response to reduce the probability of false alarms. Unfortunately since distant valid targets produce low frequency signals the overall pattern coverage is decreased as a result.

According to a different arrangement the sinusoidal signal is fed into an absolute value circuit and when this signal exceeds a minimum threshold its amplitude is used to vary the charge current of a capacitor which is used as a energy storage device. The charging current equation is $$I_{charge}=(V_{signal}-V_{minimum}\text{ threshold})/R_{charge}$$

When a certain amount of energy over time (in volt seconds) has been accumulated in the capacitor the unit will signal an alarm. This technique is an improvement over previous methods in that the effects of low amplitude transients which barely cross over the minimum threshold are reduced. This is accomplished as their energy over time is low and thus their contribution to the accumulated total energy is low. This technique does require the gain of the amplifier to be excessively high to quickly generate an alarm condition by far-off targets moving at low speed. This presents a problem for RF induced transients which are greatly amplified as a result of this excessive gain requirement.

The present invention seeks to overcome the problems associated with the prior art techniques and provide a system having improved information processing allowing more accurate evaluation of the signal. The invention in the simplest form is relatively inexpensive but the system is also capable of a high degree of sophistication and evaluation of the signal for more demanding applications. The invention recognizes that the alarm criteria is not necessarily the most appropriate to determine a trouble signal indicative of changes in the working environment or whether the environment is such that the alarm criteria must be changed or the overall operation of the system reassessed.

SUMMARY OF THE INVENTION

An intrusion detection system according to the present invention has at least one sensor for determining the presence of an intruder, alarm processing means for processing the signal from the at least one sensor and produces an alarm based on the characteristics of the signal from the at least one sensor which characteristics are indicative of an intruder in the monitored space. A supervisory signal analysis arrangement is included which evaluates the signal from the at least one sensor for changes in the environment of the monitored space which could give rise to a higher probability of false alarms and produces a trouble indication when the evaluation of the signal indicates the environment has reached a predetermined condition where false alarms are likely to occur. This allows corrective steps to be taken prior to false alarms occurring. The supervisory signal analysis arrangement applies different criteria for signal processing and analysis than the criteria of said alarm processing means whereby changes in the environment are analysed by a criteria appropriate for an assessment of the operating environment.

According to an aspect of the invention, the supervisory signal analysis arrangement processes the signal by means of a series of comparators having different stepped minimum thresholds within the normal amplitude range of the signal of interest whereby the output from the comparators allows the magnitude of the amplitude of the signal to be assessed relative to the stepped minimum thresholds. The arrangement also assesses the rate at which the amplitude of the signal increases and includes means for producing a signal of predetermined amplitude from each comparator and of a duration corresponding to the duration the signal is above the respective minimum threshold. Different weighting factors are applied to the signals from each comparator and the weighted signals are combined and evaluated.

According to an aspect of the invention, a method for processing an output signal from a detector of an intrusion detection system which output signal corresponds to the changes in infrared energy in the area being monitored is disclosed. The method comprises dividing said signal into a first and second division with the first division being processed for alarm condition analysis and the second division processed for trouble in the operating environment assessment. The signal is processed by the second division to produce at least first and second sets of pulses, with each pulse of the first set of pulses being produced when the signal is of an amplitude exceeding a first predetermined level and being of a duration corresponding to the duration the signal is maintained above the first predetermined level. Each pulse of the second set of pulses is produced during a pulse of the first set of pulses when the signal exceeds a second predetermined level which is higher than the first predetermined level and of a duration corresponding to the duration the signal is maintained above the second predetermined level. The set of pulses are analysed to evaluate whether a trouble condition exists.

A method is also disclosed for separate assessment of alarm conditions and trouble or working environment conditions.

BRIEF DESCRIPTION OF THE DRAWINGS

Preferred embodiments of the invention are shown in the drawings wherein.

DETAILED DESCRIPTION OF THE PREFERRED EMBODIMENTS

The present invention allows increased flexibility for allowing valid motion to be distinguished from naturally occurring disturbances. The invention recognizes that the signals from the sensors contain information from which an assessment of the working environment of the sensor can be made to preferably automatically adjust the alarm criteria if necessary to reduce false alarms or to allow evaluation of the environment on an ongoing basis and at various levels whereby more meaningful data is available. The technique may be implemented using conventional means such as analog circuit design techniques. The technique is also readily implemented using digital techniques to take advantage of the long term product stability, manufacturability and design flexibility offered by Digital Design.

Figure 1:
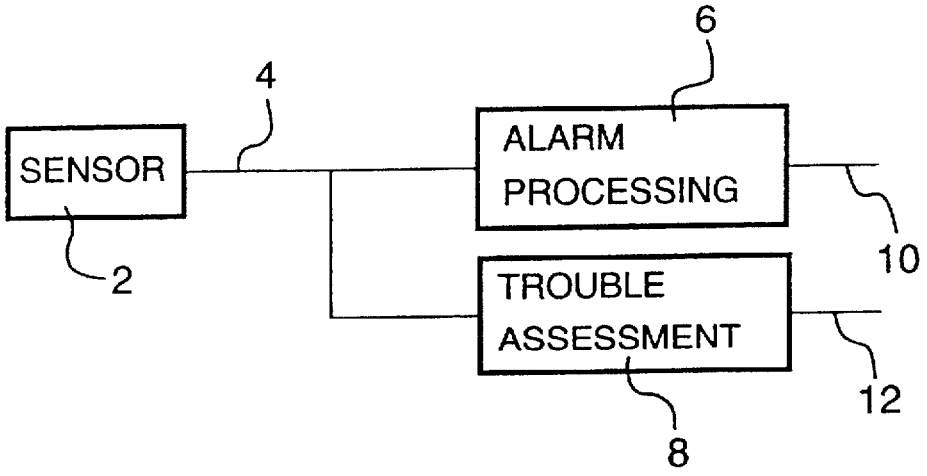
FIG. 1 is a schematic of a system using separate alarm and trouble assessment processing.

A schematic of the processing of the signal from a sensor used in an intrusion detection system is shown in FIG. 1. The sensor 2 outputs a signal sent on line 4 to the alarm processing unit 6 as well as to the trouble assessment unit 8. The alarm processing unit 6 can process the signal from the sensor in any conventional manner or at various amplitude levels and weighting factors, as subsequently discussed. The trouble assessment 8 is a separate evaluation of the signal using somewhat different criteria than the alarm processing, as it is additionally seeking out information with respect to the environment and somewhat longer term factors which can contribute to false alarms. The output from the alarm processing unit 6 is shown as 10 and the output from the trouble assessment 8 is shown as 12. In some cases, the trouble assessment may merely be a number or an index indicating the level of trouble in which the sensor 2 is operating. In other cases, it can be a number of outputs whereby the degree of trouble and the position of the trouble may be more accurately determined.

Figure 2:
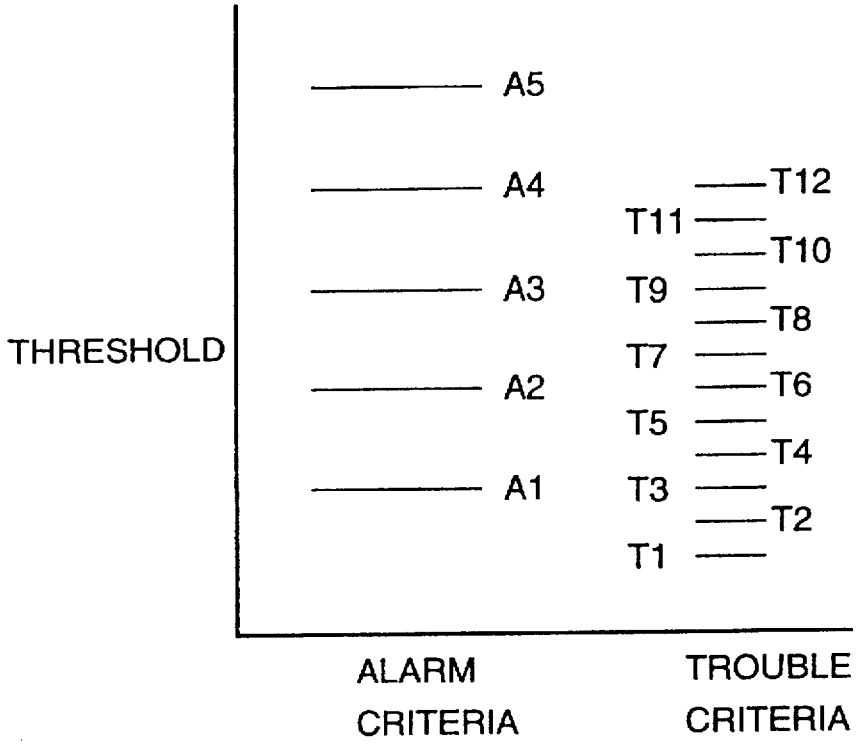
FIG. 2 is an illustration of analysis of the signal from a detector at various amplitude levels for alarm and trouble determination.

To consider how this signal 4 from the sensor 2 can be evaluated, the various threshold levels of different comparators are shown in FIG. 2. As can be seen in the lefthand side of FIG. 2, five different alarm thresholds are shown as A1 through A5. Preferably, the alarm processing unit 6 applies different weighting factors to the different threshold levels A1 through A5, and in this way, the signal from the sensor can be varied depending upon the criteria for determining whether an alarm exists. In some cases, when the signal exceeds the threshold A1, a very low weighting criteria could be applied, whereas if the signal exceeds A4, a much higher weighting factor could be applied. In this way, signals which are more typical of human motion can be determined and distinguished from signals which are less likely to be caused by humans. For example, there may be some non-human type signals which may influence levels A1 through A3, whereas if you know the signal is in A4, it is more important and should be afforded a higher weight. An A3 condition may still be important, but should require additional detections or confirmation relative to an A4 condition. In any event, the various levels of threshold allow customizing of the alarm processing and the application of different weighting factors as may be appropriate for the particular user or as may be required by the particular environment.

Trouble assessment typically begins at lower thresholds, as this is the portion of the signal which can include much of the environmental effects. Other transient type environmental effects can show up in the higher threshold levels and can overlap with low alarm factors. The assessment of trouble can have much tighter divisions to allow further discrimination of the signal. The assessment of trouble is often looking for longer term effects and need not be as concerned with the criteria for alarms to quickly produce a signal indicating a human has entered the environment. Therefore, longer term analysis of the signal can take place, some dampening or approximating of the signal can take place, and different weighting factors can be applied. Therefore, the system of FIG. 1 recognizes that trouble assessment will involve different criteria than alarm assessment, although there can be overlap in the analysis of the signals and each signal can be analysed by the multi-level approach.

Figure 3:
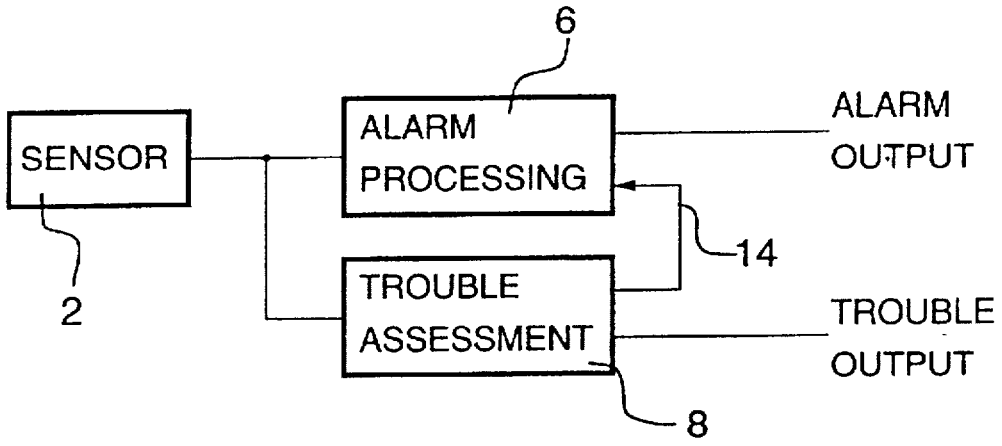
FIG. 3 is a schematic of an alarm system using a feedback arrangement from trouble assessment to vary the alarm processing steps.

With the arrangement of FIG. 3, there is a feedback mechanism whereby the trouble assessment can be used to vary the alarm criteria. For example, in some cases it may be desirable to maintain a certain head room or spacing between what is considered the average environmental signal and the first level of alarm or a particular level of the alarm having a relatively significant waiting factor. In a one or single threshold alarm system, you may merely want to space that level a certain additional amplitude above the average environmental effect. This is accomplished in FIG. 3 by the feedback loop 14. In this case, the alarm processing unit 6 includes variable criteria which can be influenced by the feedback system 14.

Figure 4:
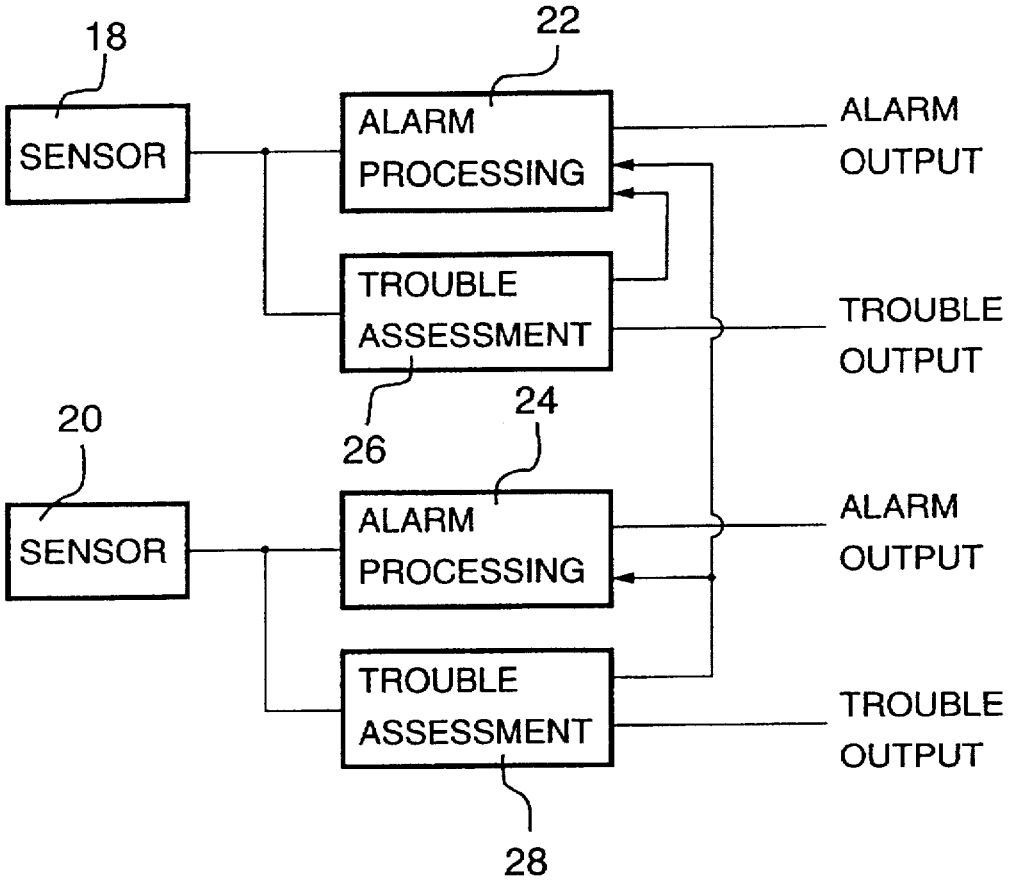
FIG. 4 is a schematic of a dual detection system where each sensor has separate trouble assessment and there is cross feedback to additionally vary alarm criteria of each sensor based on the trouble assessment of the other.

In FIG. 4, a dual detection system is shown having a first sensor 18, a second sensor 20, a first alarm processing unit 22, a second alarm processing unit 24, a trouble assessment for the first sensor 18 labelled 26, and trouble assessment for the second sensor 20 labelled 28, with each of the alarm processing units 22 and 24 including cross feedback from the opposite trouble assessment 28 and 26, respectively. Each of the alarm processing units 22 and 24 also include feedback from their own trouble assessment. In this way, depending upon the particular assessment of trouble and the signals, the alarm processing of the particular sensor may be varied, and in some cases, the alarm processing of the other sensor may be varied. This can be carried out by increasing or decreasing the particular alarm processing sensitivities. Sensors with adjustable sensitivities are known, however, their adjustment is generally adjusted and thereafter remains at the adjusted level. For example, if the first sensor 18 was a microwave sensor and sensor 20 was a passive infrared, if a heater came on within the environment of the sensor 20 sufficient to raise the trouble assessment, the sensitivity of the alarm processing unit 24 may be moved upwardly whereby the possibility of a signal alarm may be less. In this case, because the environment of the passive infrared sensor has become more troublesome, it may be necessary to increase the sensitivity of the microwave system. On the other hand, what might occur is that the microwave system may have previously been operating at a very high sensitivity due to the fact that the passive infrared sensors seldom malfunctioned and, therefore, the sensitivity of the microwave sensor must be decreased now because the chance of the passive infrared sensor producing an alarm output would increase because the environmental effect for that particular sensor has been raised. Therefore, with this system, there can be cross feedback between the two systems to customize the variations. Typically, in any dual detection technology there is some judgement in setting the sensitivities of these units, and with the arrangement of FIG. 4, this judgement can be exercised, on an ongoing basis as opposed to a single assessment or fixed assessment.

Figure 5:
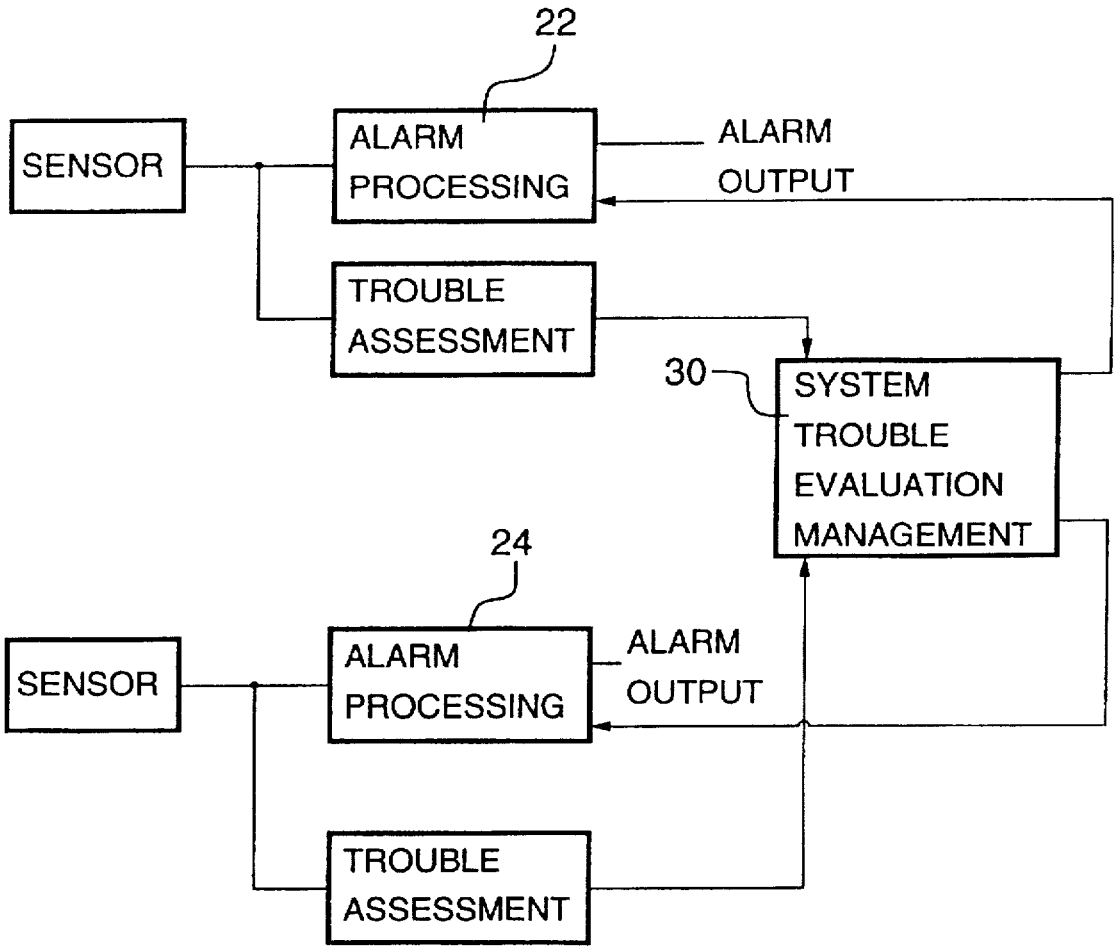
FIG. 5 is a schematic of a system similar to FIG. 4 with additional trouble assessment analysis based on the combined trouble assessment of the sensors.

In the arrangement of FIG. 5, the dual sensor technology of FIG. 4 has been combined with an additional system trouble evaluation identified as 30. In this case, trouble assessment is forwarded to the overall system trouble evaluation. Based on the trouble assessment from each of the detectors, the system can then evaluate a strategy for varying each of the alarm processing units 22 and 24. This allows ongoing management based on the combined findings of both trouble assessments, where both trouble assessments can be inputted and modify each of the alarm processing criteria 22 and 24.

It can be appreciated with the systems of FIGS. 4 and 5 that there need not be a feedback loop and it may be sufficient merely to provide a record of the trouble evaluation for subsequent trouble occur, or it may merely occur, or it may merely allow people to continue to monitor trouble evaluation and they can manually adjust the system of alarm processing or trouble assessment, if desired. In any event, the evaluation of trouble at the various levels, as shown in FIG. 2, allows customizing of the system for the particular sensors being used, i.e. passive infrared, microwave or ultrasonic, as well as customizing due to the known environment in which the sensor is going to be placed. Various weighting factors can be applied to the outputs from the various threshold levels, and as discussed in the previous application, the duration of the signals above those thresholds can also contribute to the evaluation.

Figure 6:
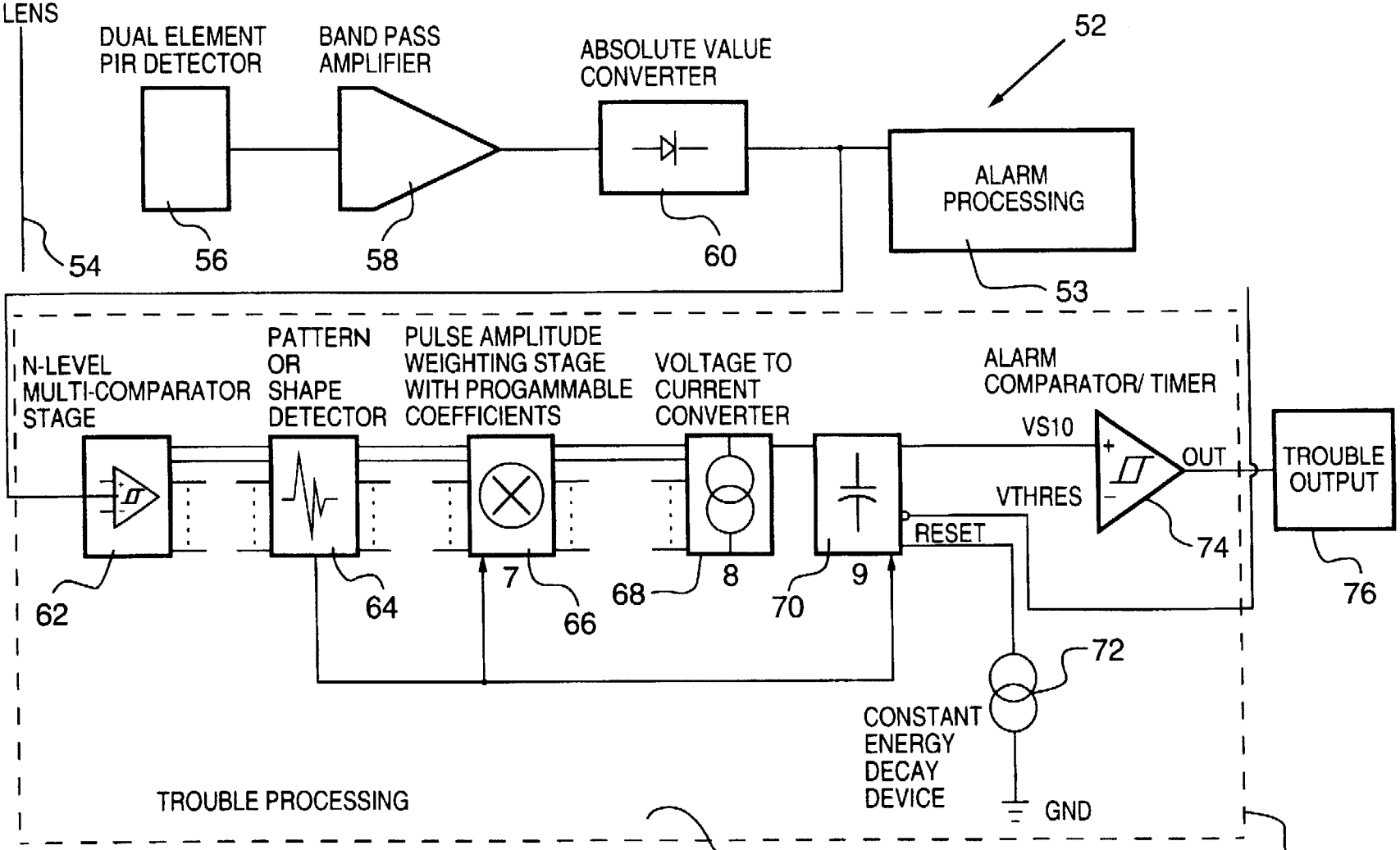
FIG. 6 is a schematic layout of the passive infrared detector.

A schematic of the infrared motion detector system 52 is shown in FIG. 6. The system includes a lens assembly 54 which focuses infrared energy originating from sources within the area of coverage on the two dual element passive infrared detector shown as 56. The resulting output is amplified and band pass filtered by the band pass amplifier shown as 58. The band width of the band pass amplifier 58 is approximately 0.1 hertz to 10 hertz.

The signal is then passed through an absolute value convertor 60 which is a full wave rectifier. This technique is used to conveniently analyse average energy content in the cyclic signals.

Figure 8:
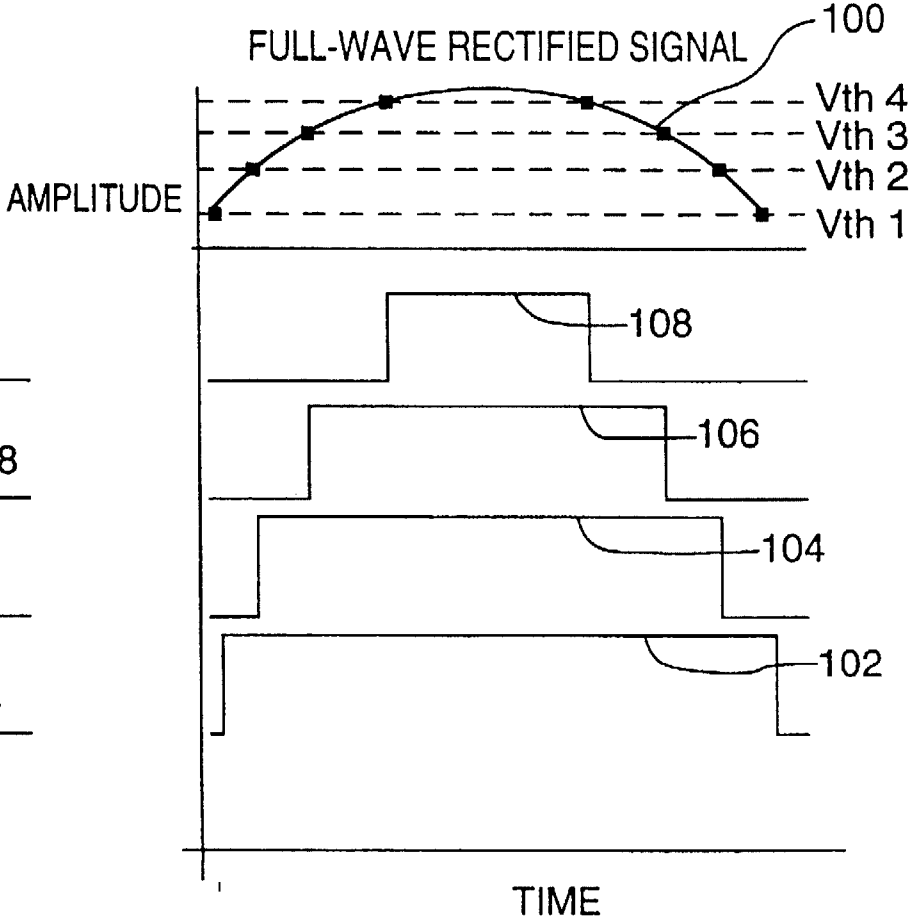
FIG. 8 is a schematic of the response from a generally symmetrical pulse of a full wave rectified signal when processed by the four comparator system with the resulting pulses being shown.

The full wave rectified signal 50 is then fed into an alarm processing unit 53 and into a trouble or supervisory signal processing unit 55. Alarm processing unit 53 may be of the conventional type or use an arrangement similar to trouble processing unit 55 modified for alarm detection criteria. Trouble processing unit 55 includes an n level multicomparator stage 62 which has been preconfigured to analyse the maximum dynamic range of the signal by evaluating the signal at n predetermined minimum threshold values stepped throughout the maximum dynamic range. As the input signal crosses each of these thresholds, a corresponding output pulse is generated at the corresponding comparator output. The pulse has a fixed magnitude, which is a function of the dynamic range of the system. The rectified signal can be characterized by accumulation of the energy of the output pulses from multi stage comparator 62. The more levels that are used, the more information that is extracted from the input signal. The output pulses from the n level multi comparator 62 are then passed through the pattern or shape detector 64 which analyses the signal for certain characteristics. Part of this analysis, which is carried out by a microprocessor based on the information from the multilevel signals, includes pulse symmetry evaluation which is sensitive to the instantaneous change in the number of comparator outputs tripped. If the rate is too high due an an RF induced transient event for example, the result in output pulses to the next section, i.e., the pulse amplitude weighting stage 66 are reduced in duration reducing their effect on the energy accumulation storage mechanism 70. The pattern or shape detector 64 in one analysis is tailored to detect the symmetry of an RF induced transient signal which is shown in FIG. 8 and is characterized by a sharp initial transition followed by an exponential decay. For normal signals of a nonrepetitive nature, the output pulses from the pattern or shape detector 64 are identical to the pulses originating from the n level multi comparator 62.

The pattern or shape detector 64 can identify RF transient signals, and in some cases the weight thereof is reduced. It is also possible to increase the weight thereof to produce a trouble alarm, if desired by the user, so that the source of RF transient signals can be investigated and appropriately dealt with.

Certain signals, such as a rotating ceiling fan, produce a recognizable repetitive pattern which is detected by detector 64 which can appropriately modify the pulse amplitude weighting stage 66 to reduce the impact of this signal and/or modify the results of the weighted signals by the addition of a modified signal at the energy accumulation/storage device 70.

In some cases, the Pattern or Shape Detector 64 will not be required and can be deleted from the trouble processing unit 55. Similarly, in some cases, pulse symmetry detection may not be required and can be deleted. The N level comparator and weighting factors alone can provide significant improvements in the assessment of trouble and adaptability for particular environments. This is also true where the N level comparator and weighting factors are used for evaluation of alarm conditions.

It has been found that it is desirable to apply different weighting factors to the pulses from different stages. For example, although the information which is of relatively low amplitude may include some false information, the information is certainly valuable and cannot be ignored. However, when the signal is above this minimum level by a certain amount detected by the next comparator this information is a much clearer indication that a valid intruder motion detection has occurred. Therefore, different weighted factors may be applied to the different stream of pulses coming from the n level comparator. It can also be appreciated that custom tailoring of the response and weighting factors can make adjustments for particular ambient conditions or particular needs of the area being detected. Thus, it allows selection, variation and tailoring of the system to the particular environment in which it is being placed or the application that it is intending to protect. For example, it could allow customization to effect a system which is more sensitive to slow movement versus fast movement or more sensitive to near targets versus far targets. For example, far off detection may be enhanced without increasing the probability of false alarms due to heaters by increasing the weighted factors used on the second and third level comparator outputs while decreasing the weighting factor of the first level comparator outputs which is typically the minimum level of interest. The weighting factors directly effect the rate of charging the energy accumulation storage device 70 per recognized event. The pulses which are most often produced by human motion near or far, moving slow or fast will be given the most weight while those most often produced by common transients will be given a lower weight. The more comparators implemented the higher the degree of sophistication possible and the increased ability to distinguish between various disturbance sources throughout the monitored range.

This in effect allows a low or overall weight to be assigned to "average" signal energy produced by transients and high overall weight to the average signal energy produced by valid motion to minimize the probability of false alarms while enhancing the detection capability of the detector. This capability is not possible via traditional single time constant single threshold systems. This weighting factor provides a further degree of freedom and allows the amplifying requirements to be less demanding.

The weighted pulses and any modified signals (if any) are then literally added by the voltage to current converter 68. The output signal represents a weighted modification of the input signal energy. The weighting factors can also be adjusted to more accurately reflect the energy under the curve, if desired, or in contrast may be used to provide a more accurate assessment of the detector signal or detector signals by increasing or decreasing certain portions thereof to emphasize or de-emphasize certain portions of the signal. The point of this system is to allow additional freedom with respect to customized assessment of the signal to validly detect targets within the area being monitored. This system allows tailoring of the response to achieve this result and tailoring of the system to affect the environment in which it is placed.

The counted weighted pulses from the voltage to current converter 68 are stored in the energy accumulation storage device 70. If a signal is of an energy sufficient to accumulate energy quicker than it is discharged by the constant energy decay device 72, then the trouble comparator/timer 74 is tripped, signalling a trouble condition to the trouble output device 76. The actual detection of a trouble condition could light an LED or produce an audible trouble signal or be recorded in some manner. This recording step can also include recordal of the weighted pulses to allow user evaluation and possible lead to the identify of an element in the environment contributing to this condition.

After a fixed duration output devices 76 and 78 are reset as is the energy accumulation storage device 70 by the alarm comparator/timer 74.

The components and functions contained within the microprocessor outline 49 can be carried out by a microprocessor or by analogue techniques. As the levels of analysis, increase the benefits of using a microprocessor are more easily justified.

The constant energy decay device 22 decays at a rate suitable to facilitate "memorization" of recent events for some minimum time duration.

The prior art alarm systems typically trigger their detection mechanism at some predefined threshold. This is done in order to minimize the probability of false alarms and results in essentially 30% of the information contained in the area under the signal being ignored. This is done as the algorithms that are used are unable to properly discriminate the information as only one time constant is used. The present technique, particularly in the microprocessor based environment, can utilize this information for background thermal "noise monitoring" which may be used to evaluate the working environment of the detector.

The different weighting factors may be dynamically altered to enable the detector to adapt itself to temperature or environmental changes and thus maintain high sensitivity.

The information sensed and produced by the algorithm may be interpreted and processed using FUZZY LOGIC processing techniques. Fuzzy logic is a form of artificial intelligence which enables decisions to be made based on imprecise, non-numerical information, much the same way as humans do. This technique could facilitate "intelligent", dynamic alteration of the weighting factors by embedding the intelligence of the product designer into each detector. Any source of information produced by the system which may be described by a "linguistic variable" may be processed using fuzzy logic techniques. For example:

1. The "weighting_factor" may be defined as VERY LOW/LOW/MED/HIGH/VERY HIGH
2. The "ambient temperature" may be defined as COLD/COOL/COMFORTABLE/WARM/HOT
3. The "weight_change" may be defined as NEGATIVE-LARGE/NEGATIVE-SMALL/NONE/POSITIVE-SMALL/POSITIVE-LARGE By using a set of "IF-THEN" rules (A Fuzzy Inference System), a particular weighting factor (:weight_n") may be adjusted according to the following rule:

if AMBIENT TEMPERATURE is COLD and the WEIGHTING_FACTOR for "weight_n" is LOW THEN WEIGHT_CHANGE for "weight_n" is NEGATIVE SMALL Although the above example is based on three data sources, it will be appreciated that any variable sensed or produced by a motion detection system (single or dual technology) which may be assigned a "Linguistic variable" may be processed using Fuzzy Logic techniques.

The major advantage of using fuzzy logic techniques is to further reduce susceptibility to false alarms caused by the fixed thresholds in the motion detection system by offering an accurate means of adapting the detector's coefficients to suit its environment.

Figure 7:
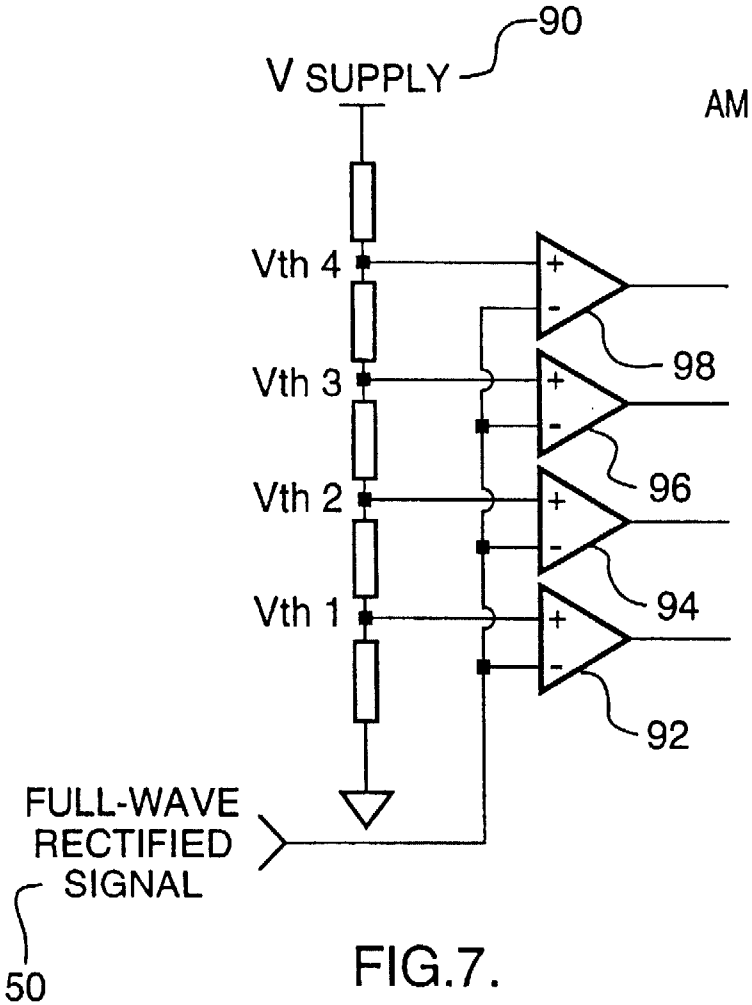
FIG. 7 is a schematic of an alternate arrangement showing a system of four comparators.

FIG. 7 shows a voltage supply 90 supplying each of the four comparators 92, 94, 96 and 98. These comparators receive the full wave rectified signal indicated as 100. The four level comparators have different minimum thresholds ($V_1$–$V_4$) with comparator 92 producing the first pulse indicated in FIG. 8 as 102 and comparator 94 producing pulse 104 and comparator 96 producing pulse 106 and comparator 98 producing pulse 108.

In this case the output from a full wave rectified symmetrical pulse so indicated at the top of FIG. 8 is being analysed. Four pulses are produced indicated as pulses 102, 104, 106 and 108. The first pulse 102 is of the longest duration and each of the pulses 108, 106 and 104 occur within the duration of pulse 102. Similarly, pulses 106 and 108 occur within the duration of pulse 104 and pulse 108 occurs within the duration of pulse 106.

It can also be appreciated from a review of the pulses of FIG. 8 that an approximation of the symmetrical signal so shown at the top of the figure has been reproduced. By adding more comparators, additional accuracy can be achieved. Furthermore, the applying of the weighting factors to the different stages can allow further discrimination of the events causing these disturbances.

Figure 9:
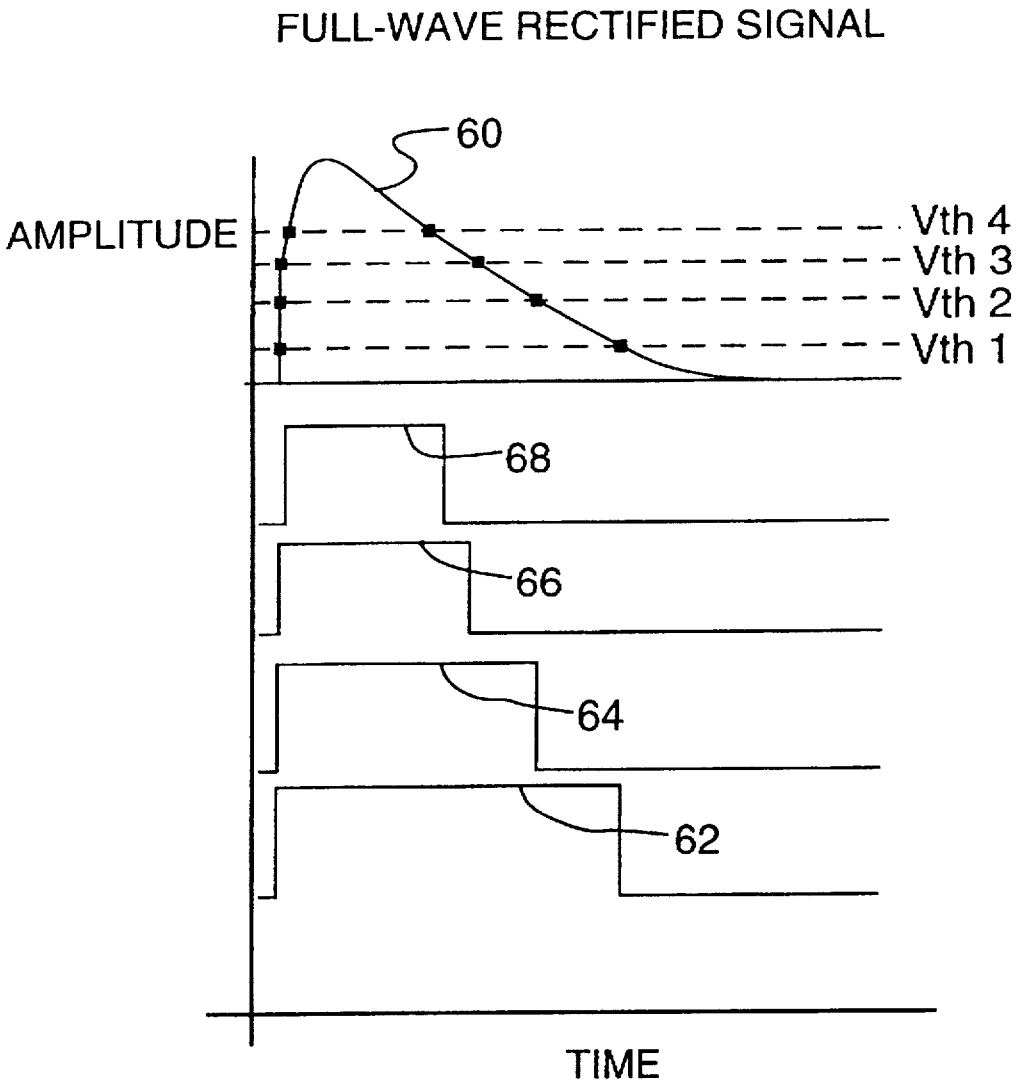
FIG. 9 is a time vs. amplitude chart showing the pulses produced from the arrangement of FIG. 7 analysing the full wave rectified signal produced from a transient RF disturbance.

FIG. 9 show the pulses produced when a full wave rectified transient RF signal indicated as 110 is being processed by the comparators. As can be seen there is an almost instantaneous tripping of the various comparators 92, 94, 96 and 98 (indicated by signals 112, 114, 116 and 118) followed by a staged reset corresponding to the decay function of the full wave rectified signal. With this information the pattern or shape detector 64 can distinguish this as an RF signal which is to be reduced in importance or filtered out. As previously described with respect to FIG. 6, different weighting factors can be applied to the pulses once it has been recognized as an RF signal or the signal can be ignored. The microprocessor based system allows the weighting factors to be changed as an RF transient signal is recognized to reduce or eliminate the importance thereof.

With this system, non linear complifying of the signal from the detector occurs to allow adjustments for frequency characteristics of the signal detector while the weighting factors accommodate adjustments based on signal amplitude.

The system has been described with respect to an analogue arrangement, however, it can easily be carried out digitally using a microprocessor. This arrangement is more suitable for higher levels of evaluation for example 4 or more levels of analysis or where the ability to alter weighting factors during processing is desired.

Although the invention has been described herein in detail it will be understood by those skilled in the art that variations may be made thereto without departing from the spirit of the invention or the scope of the appended claims.

The embodiments of the invention in which an exclusive property or privelege is claimed are defined as follows:

1. An intrusion detection system comprising at least one sensor for determining the presence of an intruder in a monitored space, alarm processing means for processing an electrical output signal of said at least one sensor and producing an alarm when the characteristics of the output signal during a first time period are indicative of an intruder in the monitored space; and a supervisory signal analysis arrangement for evaluating the output signal of the sensor for environmental conditions of the monitored space which cause the output signal to change as the environmental conditions change, said supervisory signal analysis arrangement evaluating the output signal during a second time period longer than said first time period to reduce the effect of momentary changes in the output signal, said supervisory signal analysis arrangement comprising means for evaluating at least two respective portions of the amplitude spectrum of the output signal known to be important in detecting changes in said environmental conditions for an evaluation of said environmental conditions, said supervisory signal analysis arrangement producing a trouble indication when said evaluation of said environmental conditions exceeds a predetermined level.

2. An intrusion detection system as claimed in claim 1 wherein said at least two respective portions of the amplitude spectrum include a low amplitude portion which is the result of the at least one sensor detecting background noise in the monitored space including background noise produced by lighting fixtures.

3. An intrusion detection system as claimed in claim 1 wherein said supervisory signal analysis arrangement evaluates the output signal in an amplitude portion which is eliminated during the processing of the output signal by said alarm processing means.

4. An intrusion detection system as claimed in claim 1 wherein said alarm processing means evaluates a first portion of the amplitude spectrum of the output signal for characteristics indicative of an intruder in the monitored space and said supervisory signal analysis arrangement evaluates the output signal in a second portion of the amplitude spectrum which is lower than said first portion.

5. An intrusion detection system as claimed in claim 1 wherein said supervisory signal analysis arrangement includes means for applying a different weighting factor to the resulting signal of each of said at least two respective portions of the amplitude spectrum, and combining and integrating the resulting signals for a period of time to provide the evaluation of the environmental conditions which tend to be more constant for the period of time.

6. An intrusion detection system as claimed in claim 5 wherein said alarm processing means has an adjustable criterion used to assess whether the characteristics of the output signal are indicative of an intruder, and said supervisory signal analysis arrangement adjusts said adjustable alarm criterion when said evaluation of said environmental conditions exceeds said predetermined level.

* * * * *